US007390106B2

(12) United States Patent
Walton

(10) Patent No.: US 7,390,106 B2
(45) Date of Patent: Jun. 24, 2008

(54) LIGHTING APPARATUS

(76) Inventor: Randal D. Walton, 66 Hacienda Dr., Napa, CA (US) 94558

( * ) Notice: Subject to any disclaimer, the term of this patent is extended or adjusted under 35 U.S.C. 154(b) by 0 days.

(21) Appl. No.: 11/588,959

(22) Filed: Oct. 27, 2006

(65) Prior Publication Data

US 2007/0041200 A1 Feb. 22, 2007

Related U.S. Application Data

(63) Continuation-in-part of application No. 10/393,816, filed on Mar. 21, 2003, now Pat. No. 7,178,944.

(51) Int. Cl.
*F21V 7/10* (2006.01)

(52) U.S. Cl. ..... 362/216; 362/260; 362/302; 362/304; 362/346; 362/347; D26/79

(58) Field of Classification Search ..... D26/3, D26/79; 313/634; 362/216, 260, 297, 302, 362/304, 346, 347

See application file for complete search history.

(56) References Cited

U.S. PATENT DOCUMENTS 1,870,147 A * 8/1932 Smally ..... 362/216
3,179,792 A 4/1965 Weiss
3,558,873 A 1/1971 Smith
6,033,092 A 3/2000 Simon
6,068,388 A 5/2000 Walker et al.
6,291,936 B1 9/2001 MacLennan et al.
6,356,700 B1 3/2002 Strobl
2002/0149931 A1 * 10/2002 Chang ..... 362/216

* cited by examiner

*Primary Examiner*—Stephen F Husar
(74) *Attorney, Agent, or Firm*—Kolisch Hartwell, P.C.

(57) ABSTRACT

The present invention comprises a method of enhancing illumination by a variety of lamp types through the use of reflective technologies, for example, replacement of expensive high intensity density of mercury vapor lamps with low wattage fluorescent tubes having at least one and in some cases, up to three reflective surfaces for focusing otherwise lost light toward a target illumination area. Further, the placement of light sources at the focal point of said reflective surfaces aids in optimizing the amount of light focused in a desired direction.

23 Claims, 13 Drawing Sheets

LIGHTING APPARATUS

CROSS-REFERENCE TO RELATED APPLICATION

This is a continuation-in-part of application Ser. No. 10/393,816 filed on Mar. 21, 2003, now U.S. Pat. No. 7,178,944, which is hereby incorporated by reference.

FIELD OF THE INVENTION

The instant invention may be considered to be in the field of lighting devices, specifically lamps of high intensity discharge and fluorescent lamps, but not limited thereto.

BACKGROUND OF INVENTION

Many industrial and commercial buildings have the burden of illuminating large areas from standard height as well as from higher than normal ceilings. One solution to this lighting application has been the use of high intensity discharge lamps. Mercury vapor, sodium and other high intensity discharge lamps in commercial applications may consume as much as 400 to 1000 watts, and generate an associated amount of heat, contributing to additional heating, ventilating and air conditioning ("HVAC") operation and fire protection considerations.

These lamps also utilize a certain time duration to warm up and achieve full illumination capability, resulting in time periods with less than desired lighting coverage. Such high intensity discharge lamps are also relatively expensive costing several hundreds of dollars per lamp.

Lamp manufacturers are constantly looking for ways to maximize the amount of foot candles of illumination which can be generated for a fixed amount of power consumption or wattage. These objectives have resulted in the evolution of high intensity discharge lamps which burn metallic vapors to achieve high lumen output.

A fairly common discharge lamp with a reflective lamp is disclosed in U.S. Pat. No. 6,291,936 B, issued Sep. 18, 2001 to MacLennan et al. Summarizing, the MacLennan patent discloses a discharge lamp including an envelope, a source of excitation power coupled to the fill for excitation thereof and thereby emit light, a reflector disposed around the envelope and defining an opening, and a reflector configured to reflect some of the light emitted by the fill back into the fill while allowing some light to exit through the opening. This description is typical of a high intensity discharge lamp. The high pressure sodium lamp emits the brightest light while metal halide and mercury vapor lamps emit about the same amount of light. For a lamp in the 400W range, for example, a ballast which acts as the excitation for the fill may typically consume 40 to 58 watts.

Fluorescent lamps are also used in commercial applications, often in offices and warehouses where a plurality of fluorescent tubes are positioned in front of a washboard-shaped, mirrored reflector. The purpose of the reflector is to reflect the light emitted upward back down toward the targeted illumination area. Fluorescent lamps differ from high intensity discharge lamps in that the "strike" time (the time to excite the interior of the lamp) is short—almost immediate, where the high intensity discharge lamps must warm up to full illumination. Fluorescent lamps also operate at a cooler temperature than do high intensity discharge lamps. The same approach may be applied to retrofitting existing installations in the commercial office environment.

Fluorescent lamps are also used in residential applications. A growing trend is the replacement of incandescent lamps with fluorescent lamps to achieve not only brighter light, but also savings in power consumption.

Lamps like the Sylvania ICETRON lamp are touted as having a 100,000 hour lamp life, or roughly five times the life of a standard high intensity discharge lamp. Consequently, with such added lamp life, the amount of maintenance required to change lamps in order to maintain illumination is reduced by 80%.

When one examines the shortcomings attendant to the use of high intensity discharge lamps and the advantages of fluorescent lamps, several observations result. By comparison, fluorescent lamps provide crisp white light in comparison to high intensity discharge lamps which offer unpleasant color and distracting color shift. Fluorescent lights my also be flexibly dimmed whereas high intensity discharge lights may not be operated below 50% output.

What is needed is a lamp which can illuminate a target area with the same amount of foot candles as a high intensity discharge lamp without consuming the same amount of energy, without requiring a warm-up period, and in operation generating less heat.

There exists a further need for high intensity discharge lamps which can illuminate a target area with the same amount of foot candles as a higher wattage, high intensity discharge lamp without consuming the same amount of energy.

Also, what is needed is a lamp which can illuminate a target area with the equivalent of foot candles as an incandescent lamp, but without consuming the same amount of energy.

Further, if the illuminating capability of a high intensity discharge lamp could be accomplished without the high capital cost associated with the purchase and operation of such lamps, the relative operating cost of illuminating industrial and commercial buildings would be reduced. The same can be said for the improvement of residential illuminations as well.

If such a lamp as described immediately above were developed, the cost of retrofitting fixtures with such lamps would be paid for relatively quickly by the associated savings from reductions in energy consumption.

One area of the art that remains to be fully developed is the optimal use of reflective surfaces to assist in directing light which would normally travel away from the targeted illumination area.

SUMMARY OF THE INVENTION

The present invention combines the advantages of compact fluorescent light tubes with reflective technology aimed at retrofitting high intensity discharge lamps in industrial and commercial applications. Applicant's invention also combines the advantages of high intensity discharge, incandescent and other light sources with reflective technology aimed at retrofitting each type of lamp for industrial, commercial, and residential applications.

By using a combination of cooler operating fluorescent tube lamps with concentrating reflective surfaces, an equivalent illumination result can be achieved at a reduction in energy consumption in the range of 40% to 74%. As a result of the much lower cost of a compact fluorescent lamp, multiple lamps may be used in combination to generate the equivalent illumination of a target area as that of high intensity discharge lamps.

The present invention utilizes reflective surfaces in a variety of ways to increase the intensity of light delivered to the target illumination area.

First, the lamp glass may be manufactured having a reflective surface to reflect light which would normally emanate away from the target illumination area back toward the target area, thereby increasing the amount of light delivered to said target illumination area ("TIA").

Second, a housing which is normally used for lamps such as a semi-conical or paraboloid-shaped high bay fixture, or a flat "washboard" type reflector may be retrofitted with a combination lamp and reflector which not only uses whatever reflective capability exists in the housing, but adds its own intensity focus factor to deliver light to the TIA, even delivering an equivalent amount of light at much less of a wattage rating (and thereof less power consumption) than the original lamp or lamps in the housing.

In a first embodiment of the present invention, a spiral fluorescent tube is combined with an interior reflector and a single secondary paraboloid reflector. A third reflector such as a semi-conical or paraboloid shape can be utilized by positioning the floodlight fixture at the focal point of said reflector. Important in this case is the distance between the tubes themselves as well as between each tube and its associated reflectors.

The importance stems from the amount of space needed to allow the reflector to bounce light back past the tubes and toward the TIA, and also the space needed for dissipation of heat. Convection allows cool air to be drawn past the fins and dissipating heat will protect the ballast. The compact fluorescent floodlight has a lens designed to precisely control the light from the reflector. It is covered with small, detailed shapes to direct the light into the desired beam pattern. The lens also acts as a cover to allow the lamp to act as it own fixture.

A second embodiment of applicant's invention employs an "implant" consisting of a spirally configured fluorescent or compact fluorescent lamp which is fitted with a reflective surface proximate to the interior portion of the lamp itself. This implant may be retrofitted into a conventional high-bay industrial fixture, thereby delivering an equivalent amount of light to the TIA with less wattage consumed. Each spiral lamp has proximate to it a primary reflector to re-direct light which might otherwise be "lost," meaning not directed to the TIA, and as well, a secondary reflector which helps direct the light to a third reflector which finally directs the focused light to the TIA.

A third embodiment of applicants invention employs a high intensity discharge compact fluorescent lamp consisting of an array of "spirally" configured fluorescent lamps, each fitted with a reflective surface proximate to the interior portion of the lamp itself. This "HID" may be retrofitted into a conventional high-bay industrial fixture, thereby delivering an equivalent amount of light to the TIA with less wattage consumed. As in the case of the second embodiment, each spiral lamp has proximate to it a primary reflector,to re-direct light which might otherwise be "lost," meaning not directed to the TIA, and as well, a secondary reflector which helps direct the light to a third reflector which finally directs the focused light to the TIA. This triple reflective light fixture could be placed in a fourth semi-conical or paraboloid shape reflector and can be utilized by positioning the floodlight fixture at the focal point of said reflector to increase the foot candles at the TIA and reduce energy consumption. Fins allow cool air to be drawn in, dissipating heat and protecting the ballast. The compact fluorescent floodlight has a lens designed to precisely control the light from the reflector. It is covered with small, detailed shapes to direct the light into the desired beam pattern, but could also be smooth. The lens also acts as a cover to allow the lamp to act as its own fixture.

In a fourth embodiment, a plurality of spiral lamps having primary reflectors is positioned inside a plurality of secondary reflectors. This array is then positioned inside a single third reflector having its own focusing characteristics, thereby further optimizing the delivery of light to the TIA. Consistent with the applicant's approach, the array is positioned at the focal point of the third reflector.

In a fifth, or preferred embodiment, of the instant invention a light source is positioned at the focal point of a reflective surface which optimizes the amount of light which is directed to the TIA. In this embodiment, a small wattage fluorescent tube is placed inside a second tube having a partially reflective surface and in some cases, a partial lens. An all-in-one open "said" Reflector Lamp can also be used by placing a smaller lamp at the focal point of said reflector. The placement of the smaller fluorescent tube is determined by the focal point of the second outer tube, thereby dependent upon the diameter of the second outer tube.

In a sixth embodiment of the present invention, a U-shaped tube is positioned at the focal point of a reflective surface thereby optimizing the amount of light which is directed to the TIA. Also, in this embodiment, a small wattage fluorescent tube is placed inside another tube or concave, open reflector having a partially reflective surface.

In a seventh embodiment of the instant invention, a high intensity discharge lamp employs a light source at the focal point of a reflective surface again optimizing the amount of light which is directed to the TIA. In this embodiment, a small wattage HID "said invention" Reflector Lamp is placed at the focal point of an outer second reflective surface. The placement of the small light source is again determined by the focal point of the bulb.

In another embodiment, an incandescent lamp employs a light source at the focal point of a reflective surface which optimizes the amount of light which is directed to the TIA. In this embodiment, a small wattage incandescent "same said" Reflector Lamp is placed at the focal point of an outer second reflective surface. The placement of the small light source is determined by the focal point of the bulb.

As one can see, a variety of different shaped lamps can be positioned in the focal point of a reflective surface, even taking advantage of a reflective surface with multiple facets, thereby increasing the amount of light reflected toward the TIA. The placement of the light is typically determined by the focal point of the reflector, thereby dependant upon its diameter. The resultant light delivered to the TIA is consistent with the values expressed in Tables A, B, and C.

The focal point is determined using the formulas developed to describe light reflected from a concave mirror. The equation may be expressed as $f=R/2$, where R is the radius of the mirror (in the case of the preferred embodiment, the outer tube) and f is the focal length, or the distance from the mirror where the light source should be placed for optimal reflection.

Graph 1 shown in FIG. 16 illustrates how the various types of lamps; i.e., fluorescent, halogen, mercury vapor and high pressure sodium compare with one another. As can be seen from the table, the fluorescent bulb has a higher color rendition index, or "CRI" than other lamp media utilizing the same wattage rating of power consumption.

Graph 2 shown in FIG. 17 shows the asymptotic relationship between an object's distance from the focal point of a reflector and the associated magnification.

Summarizing, the embodiments shown herein comprise seven examples of applicant's invention:

First, a compact or fluorescent lamp such as that already available on the open market, be it spiral, U-shaped, or other configuration, is fitted with a conical (or a variety of other shapes such as concave, or a flat washboard) reflector proximate to the exterior of the lamp glass itself. The purpose of the reflector is to redirect light toward the TIA which would normally scatter in all directions. This Reflector Lamp combination may also be used in conjunction with a single secondary reflector in a combination akin to what is commonly referred to as a floodlamp type apparatus. Positioning of the lamp or lamps in said secondary reflectors proximate to the focal points thereof is advantageously employed.

Second, an embodiment comprising a plurality of spiral fluorescent or compact fluorescent lamps each having a primary reflector is positioned inside a secondary reflector at the focal point forming an array. In this embodiment, a third reflector is employed at the focal point to provide additional direction or focusing of light toward the TIA.

The third embodiment utilizes a small fluorescent tube of low wattage placed proximate to the focal point of a larger tube having, in the preferred embodiment, a reflective hemisphere acting as a primary reflector. In this configuration, light may be directed with substantial increased intensity to the TIA, and when used with a secondary reflector, may provide even more intensity to the TIA.

The fourth embodiment utilizes the amount of space needed for reflector and tubes to allow cool air to flow past the space between reflector and tubes as heat dissipates. Fin spacing allows cool air to pass the fins thereby dissipating heat. Over heating will deteriorate lamp life of the fluorescent ballast.

A fifth embodiment of applicant's invention comprises, the compact fluorescent floodlight with a lens designed to precisely control the light emanating from the reflector. Although it could be smooth, the lens is covered with small, detailed shapes to direct the light into the desired beam pattern. The lens also acts as a cover to allow the lamp to act as its own fixture.

A sixth embodiment of applicant's invention comprises, high-intensity discharge lamps with a light emitting source at the focal point of a reflective surface which optimizes the amount of light directed to the TIA. High pressure sodium is one of the most efficient HID sources available today. These lamps are used for general lighting applications where high efficiency and long life are desired while color rendering is not critical. Typical applications include street lighting, industrial hi-bay lighting, parking lot lighting, building floodlighting and general area lighting. The placement of the small light emitting source is determined to be at the focal point of the reflective hemisphere of the outer tube, thereby being determined by said outer tubes diameter.

A seventh embodiment of applicant's invention comprises incandescent lamps with a light emitting source at the focal point of a reflective surface, which optimizes the amount of light directed to the TIA. The placement of the small light emitting source is determined to be at the focal point of the reflective hemisphere of the outer tube, thereby being determined by said outer tubes diameter.

DETAILED DESCRIPTION OF THE INVENTION

Figure 1:
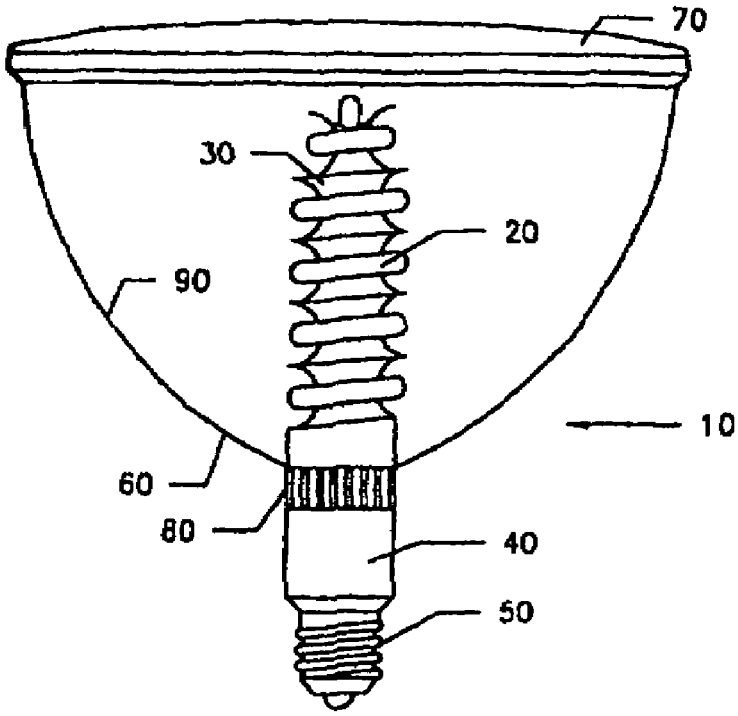
FIG. 1 is a side view of the first embodiment showing a spiral compact fluorescent tube at the focal point of a primary reflector proximate thereto and positioned at the focal point of a secondary reflector, in a configuration commonly referred to as a "floodlight;"

As seen in FIG. 1, a flood light 10 comprises a spiral compact fluorescent lamp 20 around which a primary reflector 30 is positioned. A first bonding means, such as glue or other adhesive or mechanical means is employed to fix lamp 20 and primary reflector 30 in a predetermined position. Lamp 20 is constructed in accordance with typical fluorescent lamps, comprising phosphor coating applied to the inside of the tube with hot cathodes at each end of the lamp. Air is exhausted through the exhaust tube during manufacture and an inert gas is introduced into the bulb. A minute quantity of liquid mercury is included with gas, the gas is usually argon.

The stem press has lead-in-wires connecting the base pins and carry the current to and from the cathodes and the mercury arc. Reflector 30 may be fashioned from a variety of materials including but not limited to chrome-plated glass, chrome-plated metal, polished or painted aluminum plate, painted glass, and painted plastic with a variety of reflective coatings. When utilizing molded metal for reflector 30, "mirro 4," "mirro 27" or white reflective aluminum may be selected. Commonly configured, a ballast housing 40, contains a ballast of either electrical or magnetic type, said ballast having a connecting means for electrical connection to lamp 20 and screw plug 50. A second bonding mean is necessary to attach housing 40 to lamp 20. While a bonding means in specified, other means, mechanical or otherwise, may be employed. In addition, ballast housing 40 and screw plug 50 could be fashioned as one unit rather than as separate structures, said unit having either glass, plastic, ceramic or other typical construction known in the art. The area of ballast housing 40 through screw plug 50 is typically fashioned from brass. A secondary reflector 60 in combination with a lens 70 encloses the lighting apparatus. Lens 70 can be made of glass or plastic. Fins 80 are provided on ballast housing 40 to assist in the dissipation of heat.

Secondary reflector 60, in the preferred embodiment, is of paraboloid shape, with its inner surface having a reflective coating 90 said reflector may be fashioned typically from glass, plastic, or metal.

Figure 2:
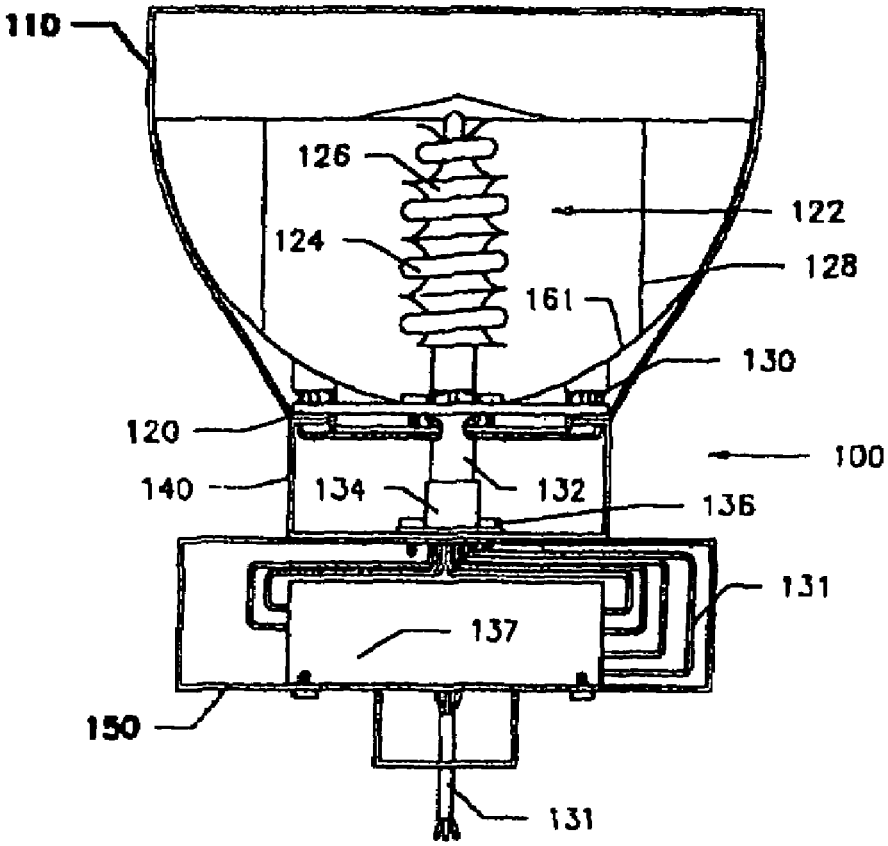
FIG. 2 is a side view of the second embodiment of applicant's invention, disclosing a plurality of spiral fluorescent tubes having primary reflectors positioned as an array and having also secondary reflectors, said array positioned in a third reflector each at its focal point.

FIG. 2 discloses an embodiment 100 of applicant's invention which is primarily employed as a retrofit of existing high bay fixtures. The common housing 110 provides a dual function as a support for a frame 120, said frame fashioned to hold an array 122 of fluorescent lamps 124 having primary reflectors 126. Array 122 further comprises a secondary reflector 128 commonly of assembled sections. Assembled sections are put into third reflector 161. Electrical connections 130, to which electrical wires 131 are attached, are positioned below frame 120 and are fed through a platform 132 and through a transition piece 134, to a fastening means 136. Fastening means 136 fixes secondary housing 140 and therefore housing 110, to a ballast housing 150, through which the electrical wires 131 again pass. These electrical wires may be hard wired to a lighting circuit.

When utilizing embodiment number two for retrofitting a typical high bay fixture such as that disclosed in U.S. Pat. No. 6,068,388 (See sheet 1 of 6), the capacitor and igniter in part 12 are replaced with a ballast. The wiring is kept along with the structure there above. The core and coil which housed in the space adjacent to part 12 is removed. Part 12 may be then fastened to secondary housing 18, each of which can be utilized in addition to reflector 21. All other numbered parts are replaced by those items listed above and below and shown in FIG. 2 and FIG. 3.

A typical high bay fixture can be retrofitted, the capacitor and igniter are replaced with an appropriate capacitor and igniter for a lower wattage high pressure sodium, metal halide, or mercury vapor lamps. The wiring is kept along with the structure thereabove. The core and coil which is housed in the space adjacent to part 12 shown above in U.S. Pat. No. 6,068,388 is replaced with the appropriate core and coil for the lower wattage lamp. All other numbered parts are replaced by those items listed below as shown in FIG. 2 and FIG. 3.

Figure 3:
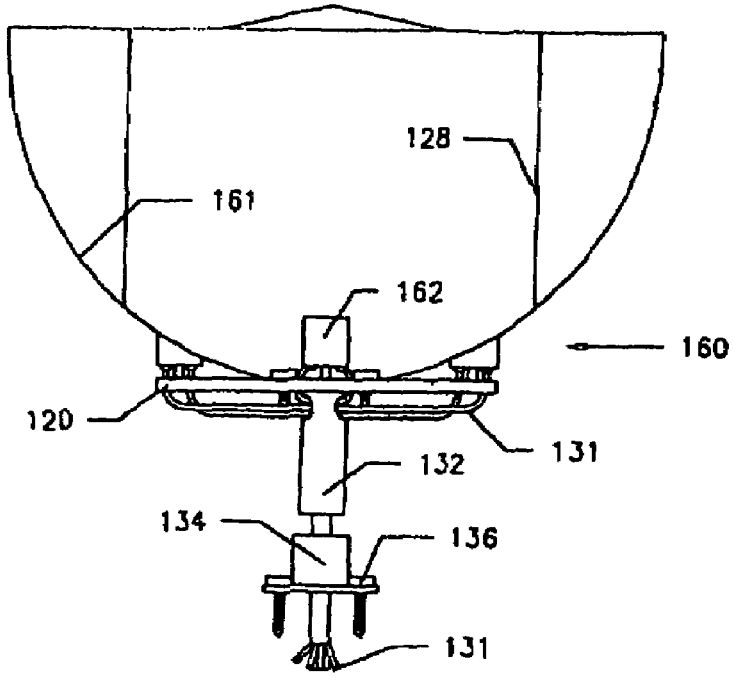
FIG. 3 is a side view of the aforementioned "implant," which may be utilized with a variety of light sources such as the spiral fluorescent tube with primary reflector and beyond, and which may be used to retrofit existing high bay fixtures.
Figure 4:
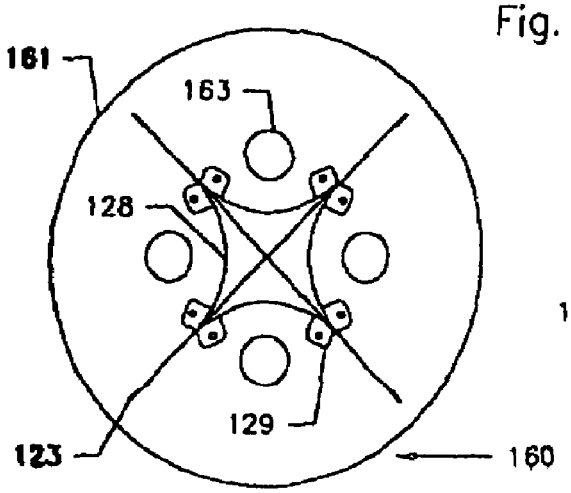
FIG. 4 is a top view of the invention of FIG. 3, further showing the orientation of secondary and third reflectors.

FIG. 3 discloses "implant" 160, described above, provided also with a third reflective mirror-like surface 161. The third reflector could also be used as a secondary reflector 161 in cases where existing technology lamps are used. The implant may be set into an existing high bay enclosure for retrofitting, The height of the implants third reflector depends on condition of reflector 110. Light sockets 162 are provided to accept lamps or other light sources as previously described, and are typically of ceramic construction. As seen in FIG. 4, access holes 163 are provided in reflector 161, allowing for the installation of light source 122, also facilitating the passage of air through holes 163.

Figure 5:
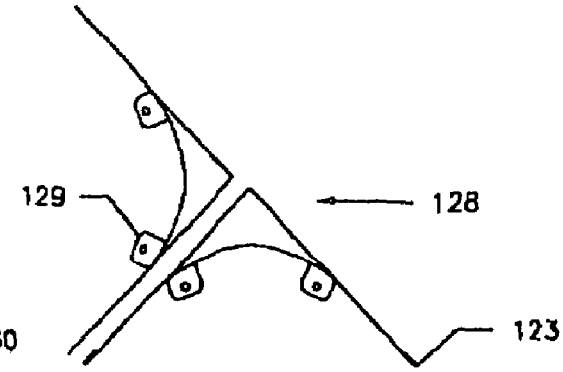
FIG. 5 is a top view of the secondary reflector of the invention disclosed in FIG. 3.

FIG. 5 further discloses secondary reflector 128, and tabs 129, used to fasten the reflector to reflector 161 of FIG. 4, typically by rivets or equivalent means. Folded metal slips 123 slip reflectors 128 together.

Figure 6:
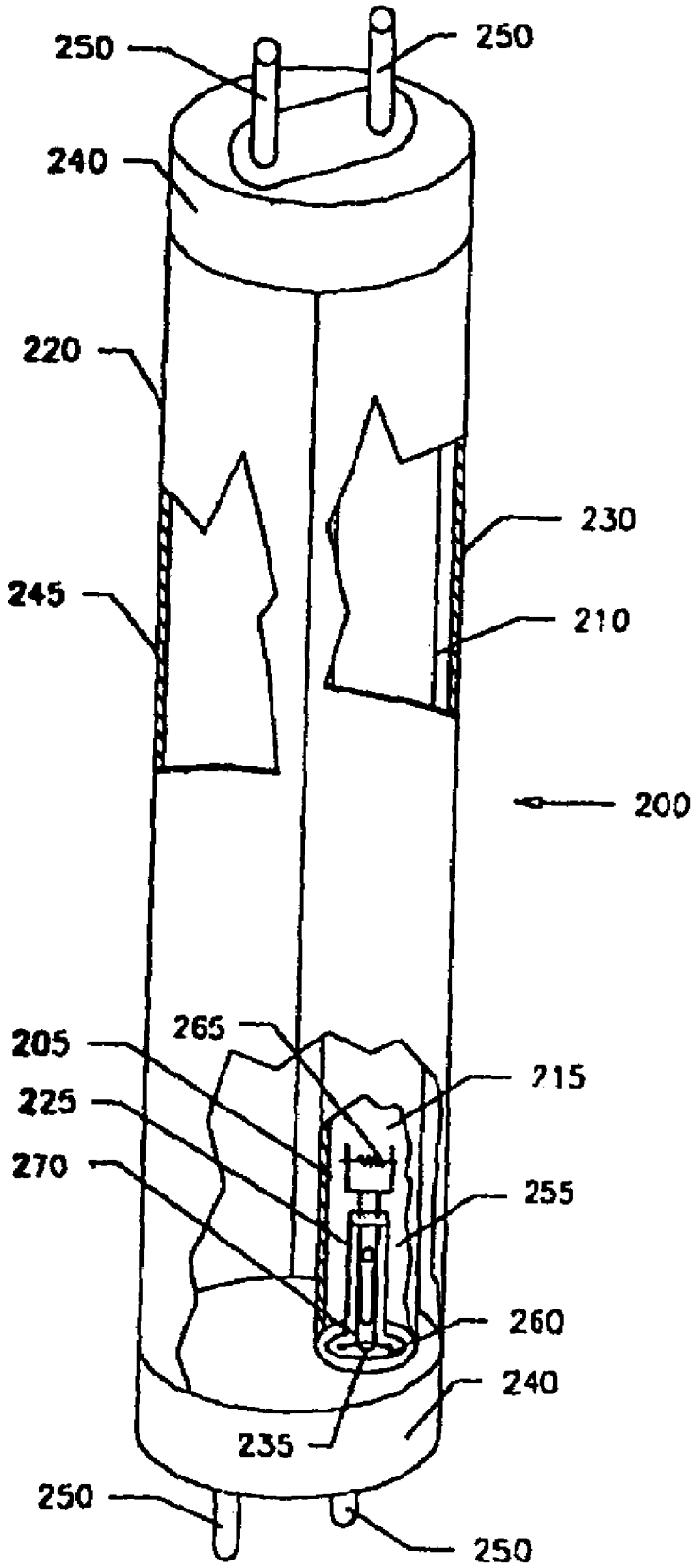
FIG. 6 is a side view of the fifth embodiment of applicant's invention, disclosing a smaller fluorescent tube proximate to the focal point of a larger cylindrical enclosure having a reflective hemisphere and manufactured as one piece.

FIG. 6 shows what appears on the surface to be a standard fluorescent tube. However, FIG. 6 depicts a lighting apparatus 200, which comprises a first fluorescent tube 210. First fluorescent tube may include a bulb 255 with Phosphor coating inside the bulb 255. Cathodes 265 at each end of lamp are coated with emissive materials which emit electrons. Air is exhausted through a tube 270 during manufacture and a minute quantity of liquid mercury 205 is place in the bulb to furnish mercury vapor. Gas 215, usually comprises Argon or a mixture of inert gases at low pressure, but Krypton is sometimes used. Stem Press 225 includes lead-in wires that have an air tight seal here and are made of specific wire to assure about the same coefficient of expansion as the glass. Lead-in wires 235 connect to the base pins and carry the current to and from the cathodes and the mercury arc. The first fluorescent tube 210 housed in a larger cylindrical housing 220. Housing 220 is usually a straight glass tube, but may also be circular or U-shaped, and may be made of plastic, glass or other suitable material. Housing 220 has a reflective hemisphere 230, at the focal point of which is located tube 210, serving as a primary reflector. Several different types of base 240 used to connect the lamp to the electric circuit and to support the lamp in the lamp holder serve to position tube 210 in proper position in housing 220, and further provide penetrations whereby pins 250 may be in electrical contact with the circuitry 260 of tube 210. Of course, the primary reflective surface of hemisphere 230 is provided on the inside or outside of housing 220, which provides reflective capability for light emitted from tube 210. Lens 245 may be smooth, but could be designed to precisely control the light from the reflector. It is covered with small, detailed shapes to direct the light into the desired beam pattern. The lens also acts as a cover to allow the lamp to act as it own fixture. A common material for lens 245 can be glass or plastic or other suitable materials. Reflector 230 could also not be enclosed to save on material costs.

Lighting apparatus 200 depicted in FIG. 6 may be manufactured as one unit or the different elements of lighting apparatus 200 may be used separately with an adapter. The benefit of these separate elements is that standard "T5" units or equivalent fluorescent lamps can be replaced, but the other parts will continually last and not need replacement.

For example, base 240 and pins 250 may be in electrical contact with the circuitry of a tombstone. The tombstone positioned at the focal point of the base hemisphere 240 can hold the smaller pins used in T5 fluorescent lamps. Several different types of lamp pins maybe used to connect lamp 210 and the tombstone. Common materials for the adaptor tombstone, pins, and connectors-could be metal, ceramic, plastic, or the equivalent.

Housing 220 of FIG. 6 may be provided in a number of suitable configurations, including a larger cylindrical housing. Housing 220 has a reflective hemisphere 230 with lens cover 245. Some common materials that could be used for housing 220 may be glass or plastic, or other suitable materials commonly employed in the art.

The fluorescent tube may also be combined with bases 240, pins 250, and fluorescent tube 210 as one unit.

Additionally or alternatively, lighting apparatus 200 may include enclosure caps and end caps with slots to hold pins 250 in place. Lighting apparatus 200 may also be employed in a secondary reflector, such as a wash board type reflective housing, thereby giving additional reflective assistance in delivering light to a target illumination area.

In lighting apparatus 200 depicted in FIG. 6 and disclosed hereinabove, standard type electrical connections including ballasts, sockets, and standard wiring are employed. Applicant's invention focuses primarily on the reflective aspects of providing additional light to a TIA, resulting in more lighting where desired with conservation of energy.

Figure 6A:
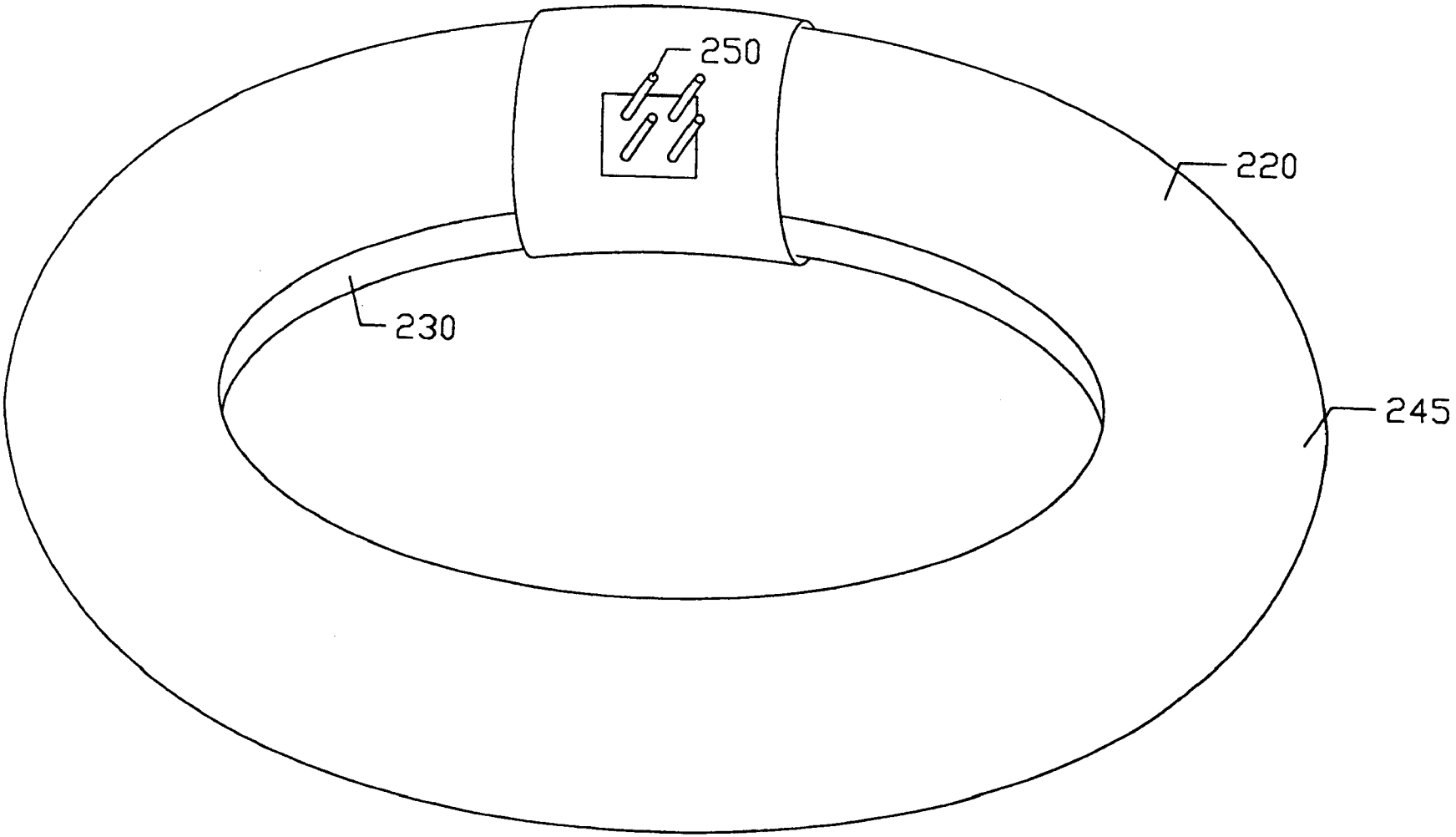
FIG. 6A is a side view of the lighting apparatus of FIG. 6 having a tubular housing of a circular shape.
Figure 6B:
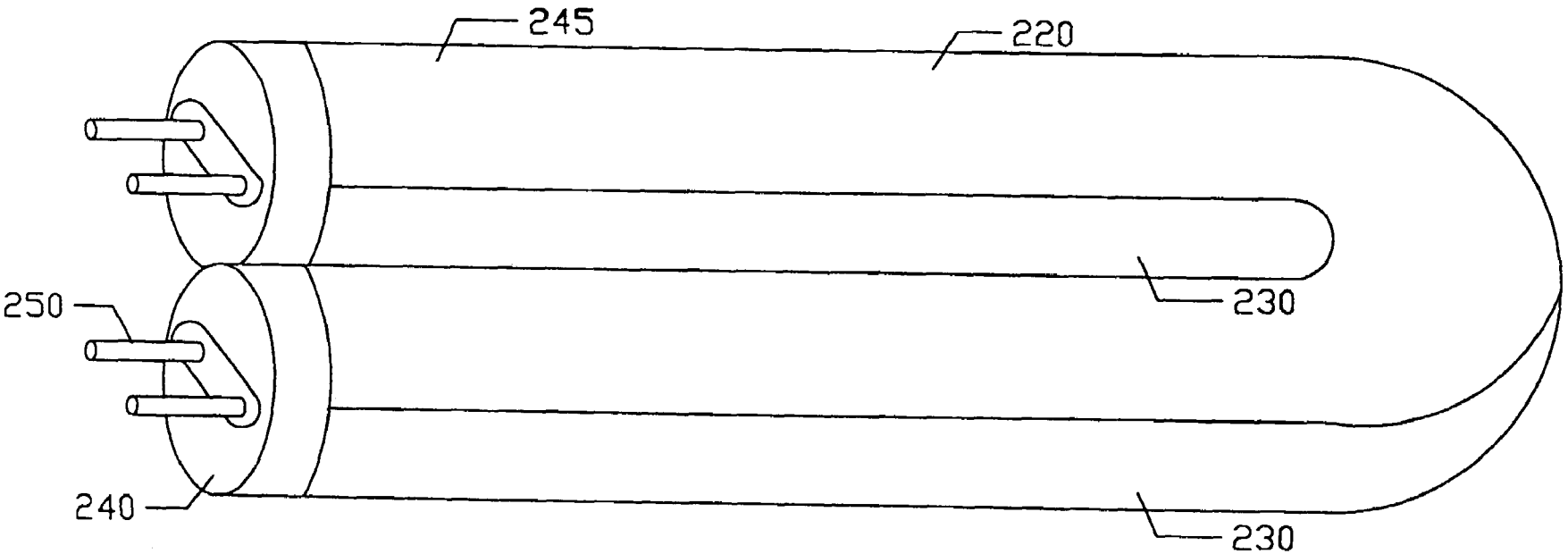
FIG. 6B is a side view of the lighting apparatus of FIG. 6 having a tubular housing of a U-shape.

FIGS. 6A and 6B depict the housing 220 shown in FIG. 6 in circular and U-shapes, respectively, as discussed above.

Figure 7:
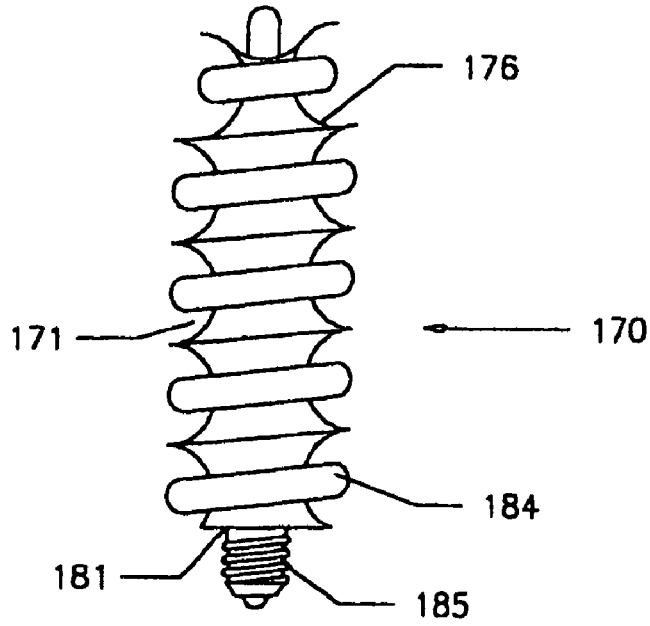
FIG. 7 is a side view of the aforementioned spiral compact fluorescent or fluorescent lamp, disclosing a smaller fluorescent spiral tube proximate to the focal point of a larger concave spiral reflector.

FIG. 7 discloses spiral compact fluorescent (or fluorescent lamp) 170 comprising a spiral compact fluorescent lamp 184 around which a primary reflector 176 is positioned. A first bonding means, such as glue or other adhesive or mechanical means is employ to fix lamp 184 and primary reflector 176 in a predetermined position. Ballast housing 181 for compact fluorescent lamp (or no ballast housing 181 for fluorescent lamp without ballast). In addition, housing 181 and screw plug 185 could be fashioned as one unit rather than as separate structures. Also air space 171, as heat dissipates cool air is drawn into space 171 cooling housing 181 and reflector 176.

Figure 8:
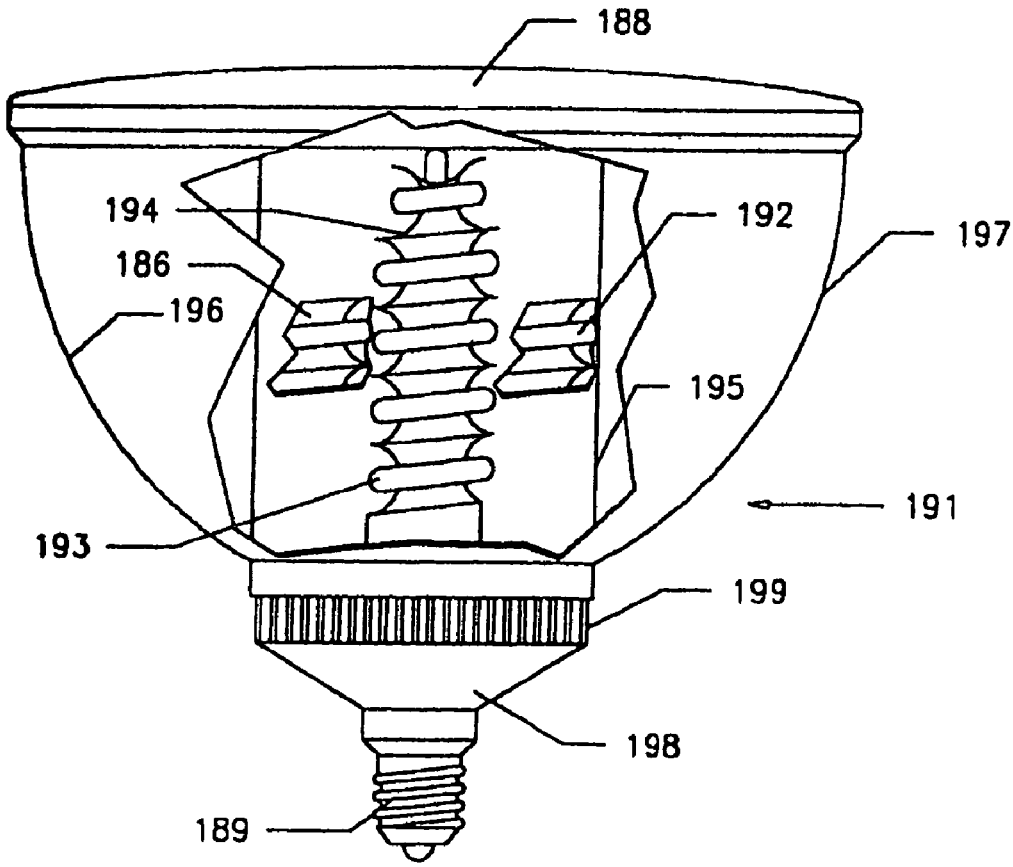
FIG. 8 is a side view of the aforementioned "HID" compact fluorescent lamp with an array of spiral fluorescent tubes with primary, secondary and third reflectors in a configuration commonly referred to as a "floodlight;"

FIG. 8 discloses the "HID" fluorescent lamp 191, of applicant's invention which is primarily employed as a retrofit of existing high bay fixtures. HID fluorescent lamp 191 holds an array 192 of fluorescent lamps 193 having primary reflectors 194. The array 192 further comprises a secondary reflector 195 commonly of assembled sections or one molded piece slips into a third reflective mirror-like surface 196 which is coated with a reflective material. The paraboloid shape housing 197 is made up of material like glass or plastic or other suitable equivalents. A variety of reflective materials may be used for reflectors 194, 195, and 196 including but not limited to chrome-plated glass, chrome-plated metal, polished or painted aluminum plate, painted glass, and plastic painted with a variety of reflective coatings. When utilizing molded metal for reflectors 194, 195, and 196 "mirro 4", "mirro 27" or white reflective aluminum may be selected. A first bonding means, such as glue or other adhesive or mechanical means is employed to fix lamp array 192 and primary reflector array 186 in a predetermined position relative to secondary 195 and third 196 reflectors housing. Commonly configured, a ballast housing 198, contains a ballast of either electrical or magnetic type, said ballast having a connecting means for electrical connection with lamp 193 and screw plug 189. A second bonding means is necessary to attach housing 198 to housing 197. Fins 199 are provided on ballast housing 198 to assist in dissipation of heat. A smooth lens 188 or a lens 188 designed to precisely control the light from the reflector is provided. Lens 188 covered with small, detailed shapes to direct the light into the desired beam pattern. The lens also acts as a cover to allow the lamp to act as its own fixture.

Figure 9:
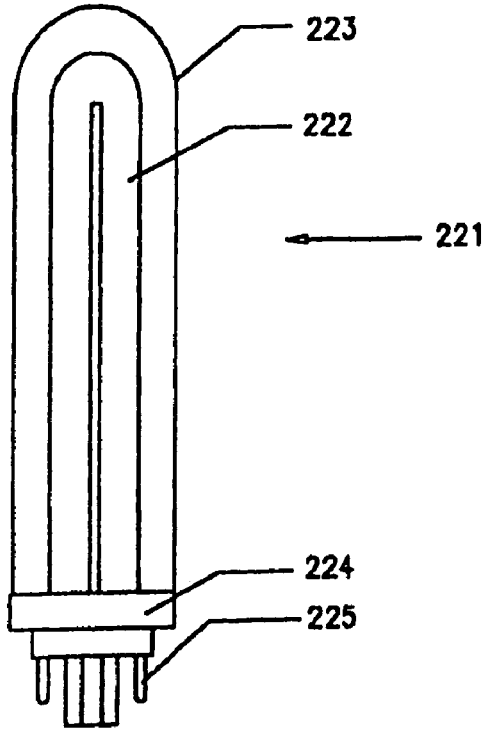
FIG. 9 is a side view of the invention, disclosing a smaller U-shaped fluorescent tube proximate to the focal point of an enclosed partially reflective tube or concave open reflector.

FIG. 9 shows a U-shaped fluorescent lamp 221 with tube 222 in a predetermined positioned of reflective surface 223. Tube 222 and reflector 223 are bonded to base 224 by glue or other mechanical means. Pin 225 and base 224 can be manufactured as one unit or as separate pieces. Many types of base 224 are used on the open market.

Figure 10:
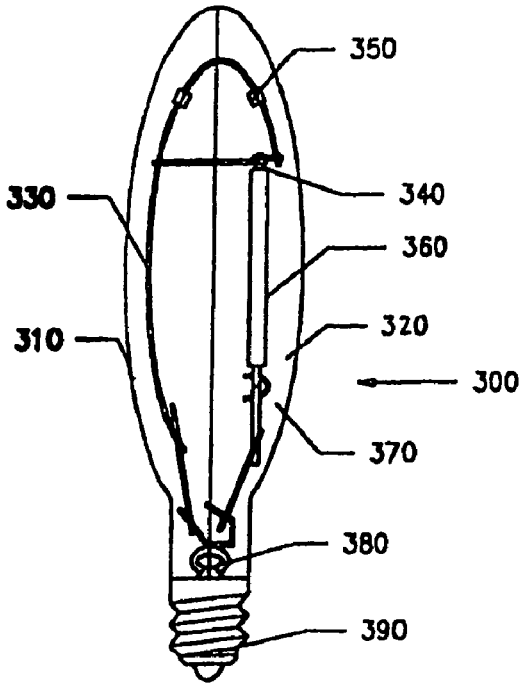
FIG. 10 is a side view of the invention, disclosing the HID high pressure sodium lamp with part of the glass envelope having reflective surface.

FIG. 10 discloses a high pressure sodium Lamp ("HPS") 300 comprising a glass envelope 310 having a substantially concave reflective surface 320. An arc tube 340, with hermetic end seal 360, typically an alumina arc tube or equivalent, is located proximate to the focal point of reflector 320 via a frame 330, usually steel. A residue gas repository 380 is positioned in lamp 300 on a base 390, where it is affixed in its location, and serves to support frame 330. Brass base 390 secures lamp 300 to a suitable light fixture and connects the light fixture's electric circuitry to the lamp. This lamp is made up of glass, metals, or other suitable materials commonly employed in the art.

Figure 11:
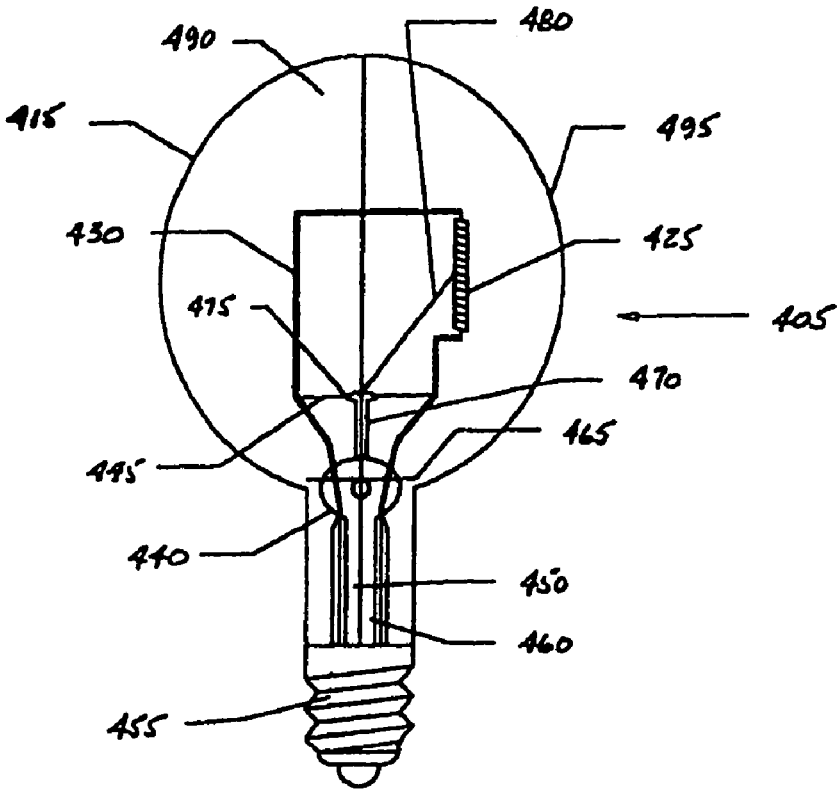
FIG. 11 is a side view of the invention, disclosing an incandescent lamp with part of the glass bulb as a reflective surface.

FIG. 11 shows an incandescent lamp 405 comprising a soft glass envelope 415. Filament 425, generally tungsten is electrically connected by wires 430 to a glass stem press 440. Wires 430 are made typically of nickei-plated copper or nickel from stem press 440 to filament 425. Tie wires 445 support wires 435 in the largest envelope area. Wires 430 pass through stem press 440, and an air evacuation tube 450 toward a base 455. In this stem press area, wires 430 transition from nickel-plated copper or nickel to a nickel-iron alloy core and a copper sleeve (Dumet wire). In this area, there exists an air tight seal at the termination of tube 450, said wires' material change made to assure about the same coefficient of expansion of the wires as the glass, and air exhaust tube 450. Base 455 is made of brass or aluminum. A fuse 460 protects the lamp and circuit if filament 425 arcs. A heat deflector 465 is used in higher wattage general service lamps and other types when needed to reduce circulation of hot gases into neck of bulb.

Glass button rod 470 projects from stem press 440 and supports button 475. Button 475 has affixed thereto support wires 480 and 485. Gas 490 a mixture of nitrogen and argon is used in most lamps 40 watts and over to retard evaporation of the filament 425. A coating is applied to glass envelope 415, creating a substantially sphere-shaped reflective surface 495. Filament 425 is located proximate to the focal point of surface 495. The lamp is made of material like glass or plastic or other suitable equivalents.

Figure 12:
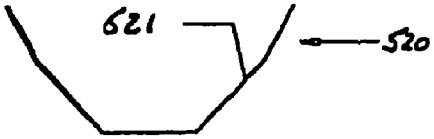
FIG. 12 is a side view of the aforementioned "reflector", disclosing a concave reflector.

FIG. 12, discloses reflector 500, a concave reflector 501, made of a variety of reflective materials including but not limited to chrome-plated glass, chrome-plated metal, polished or painted aluminum plate, painted glass, and plastic painted with a variety of reflective coatings. When utilizing molded metal for reflector 500 "mirro 4", "mirro 27" or white reflective aluminum may be selected or other suitable equivalents.

Figure 13:
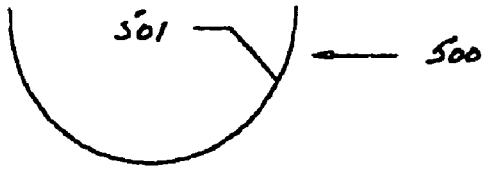
FIG. 13 is a side view of the aforementioned "reflector", disclosing a W-Shape reflector.

FIG. 13, discloses reflector 510, a W-shape reflector 511, again fashioned from a variety of reflective materials as mentioned in FIG. 12.

Figure 14:
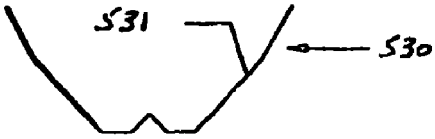
FIG. 14 is a side view of the aforementioned "reflector", disclosing a wash board reflector.

FIG. 14, discloses reflector 520, and a wash board shape reflector 521, again made from a variety of reflective materials as mentioned in FIG. 12.

Figure 15:
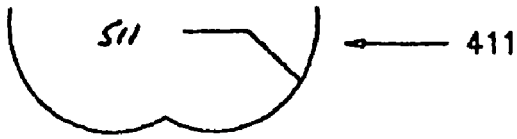
FIG. 15 is a side view of the aforementioned "reflector", disclosing a wash board shaped reflector.

FIG. 15, discloses reflector 530, and a wash board shape reflector 531, both made from a variety of reflective materials as mentioned in FIG. 12.

Figure 16:
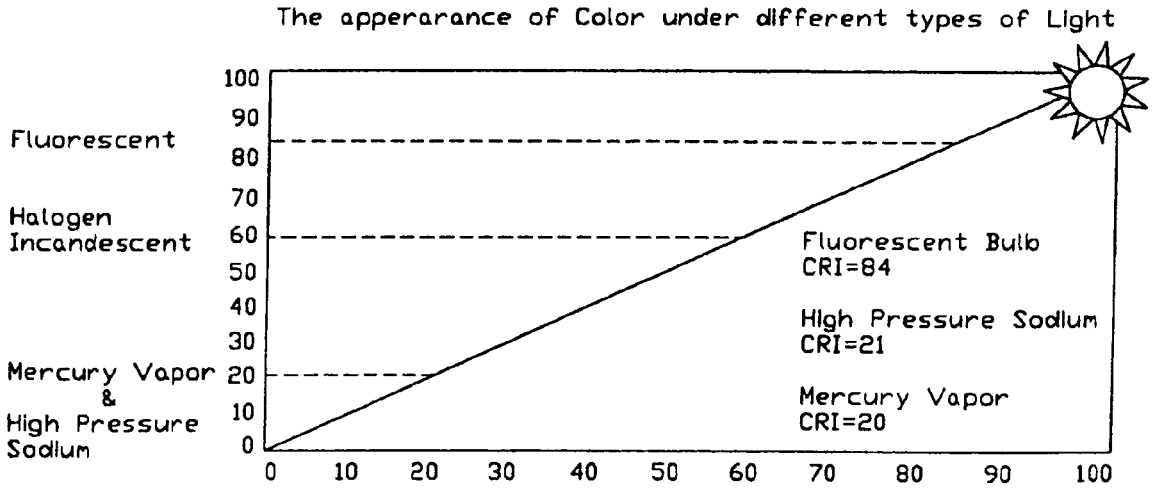
FIG. 16 is a graph showing the appearance of color under different types of light.

FIG. 16 is a graph showing the appearance of color under different types of light.

Figure 17:
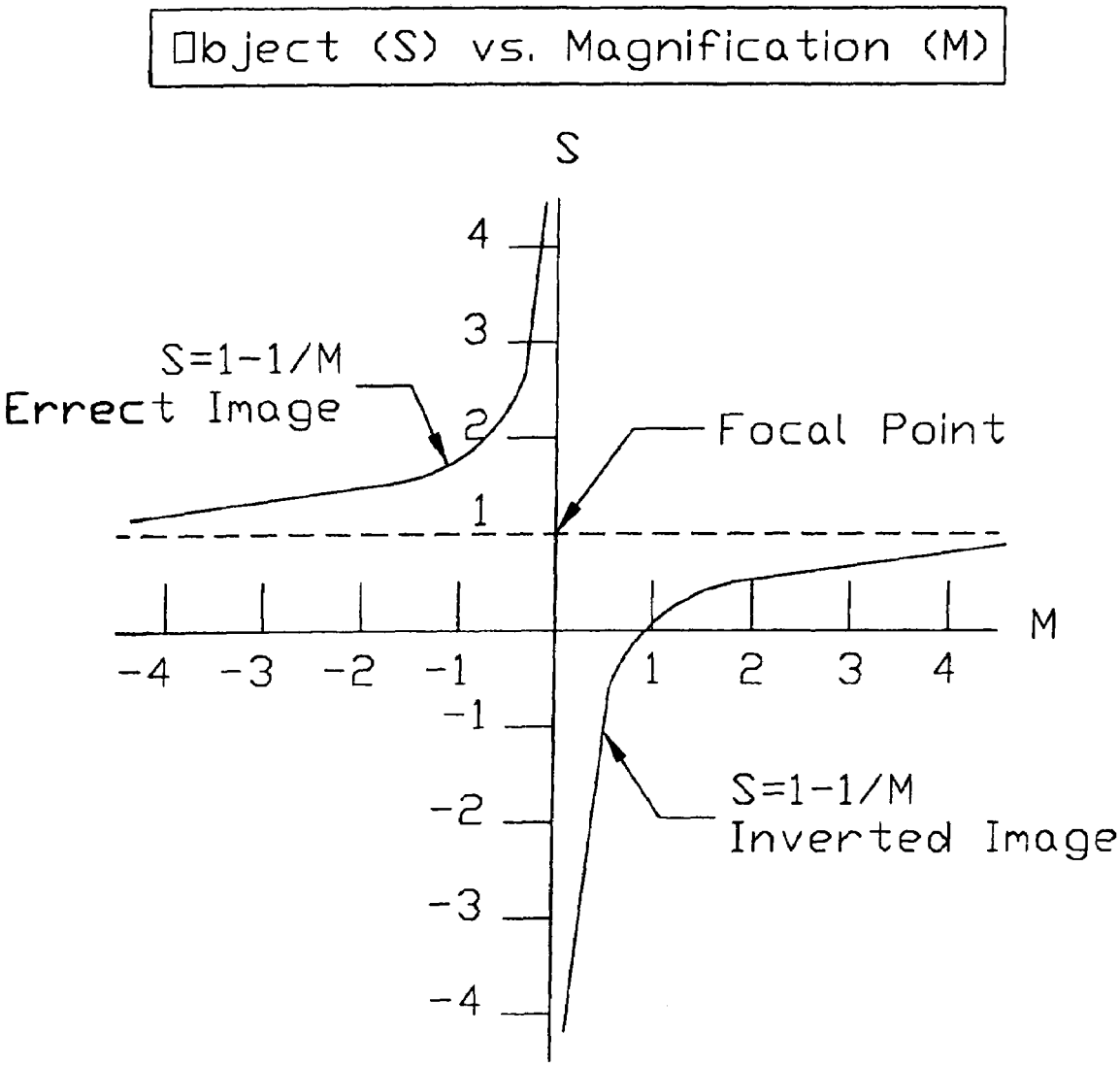
FIG. 17 is a graph showing the relationship between an object and magnification.

FIG. 17 is a graph showing the relationship between an object and magnification.

Figure 18:
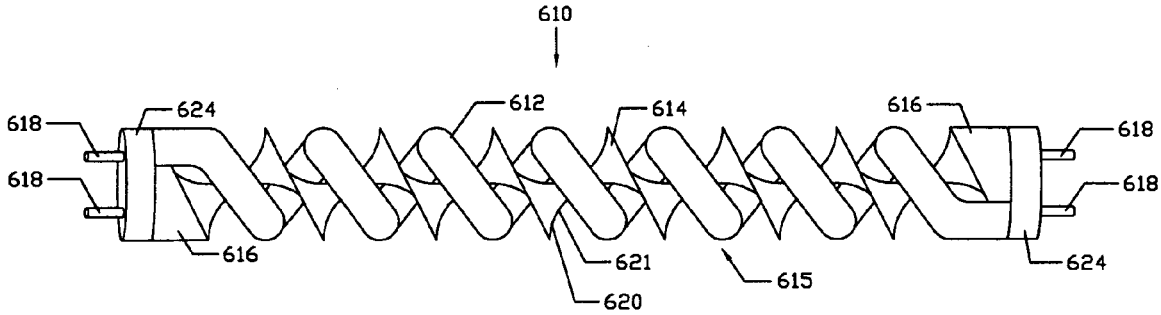
FIG. 18 is a side view of an illumination device with a light source coiled around a primary reflector.
Figure 19:
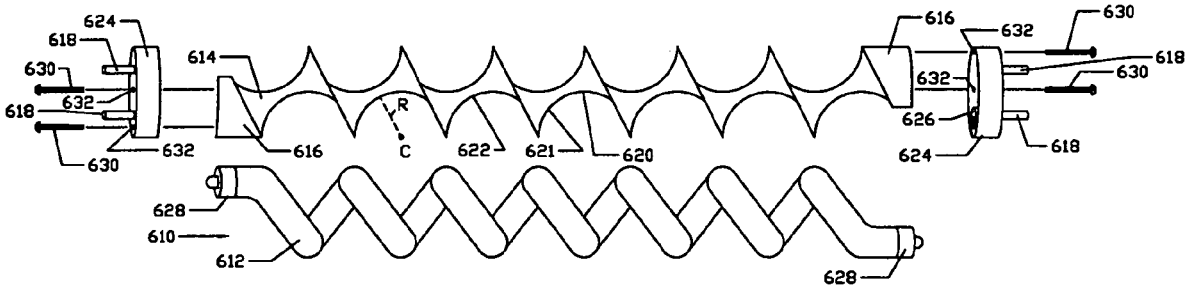
FIG. 19 is an exploded view of the illumination device of FIG. 18.
Figure 20:
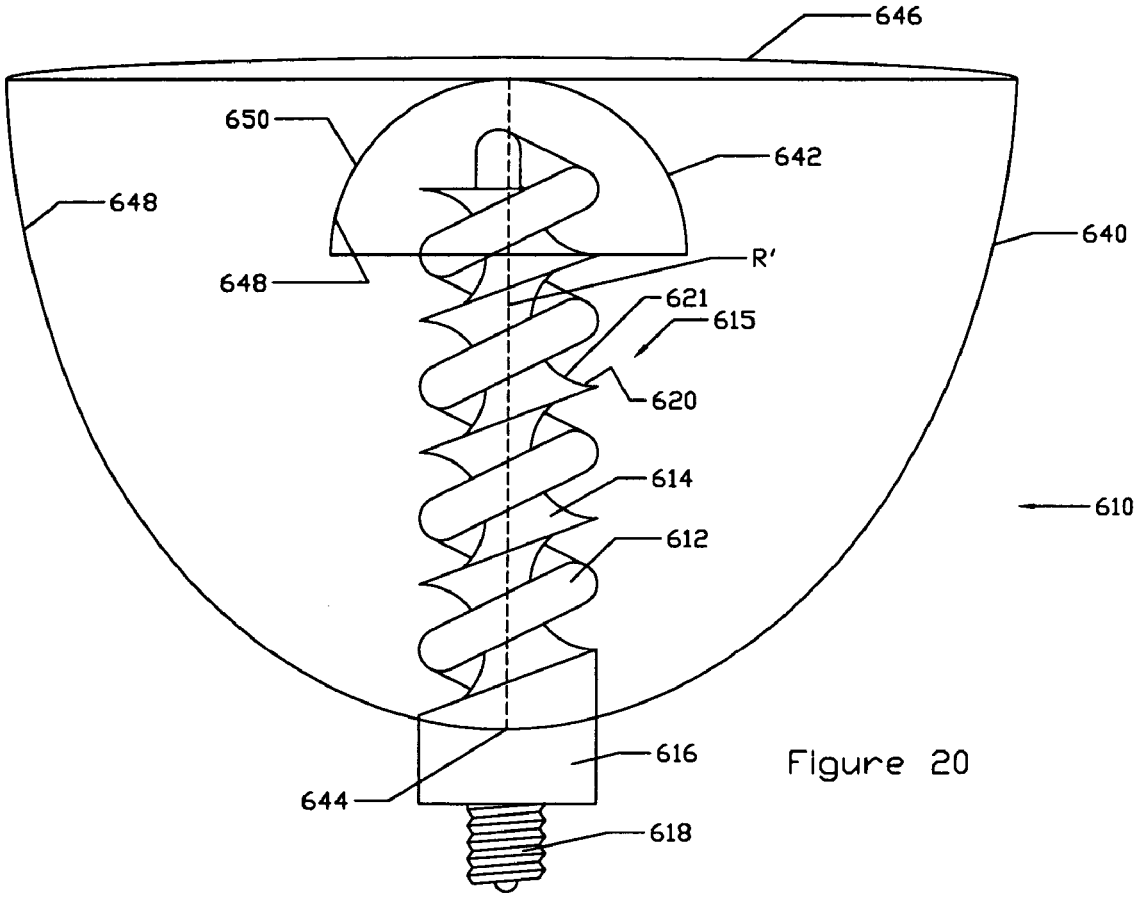
FIG. 20 is a side view of the illumination device of FIG. 18 having a secondary reflector and a tertiary reflector.

As shown in FIGS. 18-20, an illumination device 610 may include a light source 612, such as a fluorescent light, coiling around a primary reflector 614 in a helical fashion. The combination of light source 610 and primary reflector 614 may define a light reflection unit 615. Light reflection unit 615 is typically mounted to one or more bases 616.

Bases 616 may include electrical contacts 618 for electrically coupling with an external power supply. Electrical contacts 618 may take the form of any suitable type of electrical contact known in the art, such as electrically conductive pins as pictured in FIGS. 18 and 19, or a screw base connector as pictured in FIG. 20. Base 616 may house a ballast (not pictured) for regulating current flow through light source 612.

As shown most clearly in FIG. 19, primary reflector 614 may include a helical groove 620 having reflective properties. Helical groove 620 may have an interior curve forming a curved channel 621 with a helical groove apex 622. Helical groove apex 622 is the minimum (or maximum depending on the frame of reference) point along curved channel 621. The interior curve of helical groove 620 may define an effective radius R extending from helical groove apex 622 to an imaginary center C of what would be an approximate circle were curved channel 621 to extend further along its curved path. Light source 612 may be spaced apart radially from primary reflector 614 half the distance of effective radius R, which may correspond to the focal point of light reflected from primary reflector 614.

As shown in FIGS. 18 and 19, bases 616 may be fitted with endcaps 624. In some examples, illumination device 610 may include two or more endcaps 624. In the example shown in FIG. 19, fasteners 630, such as screws, secure endcaps 624 to bases 616 through apertures 632.

Each endcap 624 may include a tombstone 626 in which mating members 628 of light source 612 may insert to electrically couple light source 612 with a power supply. Tombstone 626 may be a "tombstone" style electrical connector as known in the art for facilitating electrical communication between light source 612, such as a fluorescent light, and electrical contacts 618. In the examples shown in FIGS. 18 and 19, electrical contacts 618 comprises electrically conductive pins extending from each endcap 624. The electrically conductive pins are typically configured to mate with a complimentary electrical socket linked to a power supply. Tombstone 626 may be in electrical communication with electrical contacts 618 via a ballast (not pictured), which may regulate the current flow through light source 612, such as a fluorescent light.

In some examples, such as shown in FIG. 20, illumination device 610 may include a secondary reflector 640 and/or a tertiary reflector 642. In some examples, illumination device 610 may include secondary reflector 640 without tertiary reflector 642 or vice versa. Secondary reflector 640 and tertiary reflector 642 each compliment the reflective properties of reflector 614 by redirecting light from light reflection unit 615 towards a target illumination area. However, neither secondary reflector 640 nor tertiary reflector 642 is required and one may be used without the other.

Secondary reflector 640 may generally be in the shape of a paraboloid with a secondary reflector apex 644 opposite an opening 646. Secondary reflector 640 may take additional or alternative shapes such as pyramidal, tubular, or an irregular shape. An interior surface 648 of secondary reflector 640 may have reflective properties. As shown in FIG. 20, secondary reflector may include an effective paraboloid radius R' extending from secondary reflector apex 644 to opening 646.

Secondary reflector apex 644 defines an effective minimum (or maximum depending on the frame of reference) region in the paraboloid shape. Secondary reflector apex 644 may include an apex aperture (not pictured) through which base 616 may extend. Secondary reflector 640 typically attaches to base 616 at secondary reflector apex 644 to yield certain reflective properties from the shape of secondary reflector 640. In the example shown in FIG. 20, the curved shape of secondary reflector 640 may direct light from light reflection unit 615 to a target illumination area.

Tertiary reflector 642 may also have a paraboloid shape with a tertiary interior surface 648 having reflective properties. However, tertiary reflector 642 may take additional or alternative shapes such as pyramidal, tubular, or an irregular shape. Tertiary reflector 642 may also have an exterior surface 650 having reflective properties. In the example shown in FIG. 20, light entering tertiary reflector 642 is reflected downward onto secondary reflector 640. Upon reaching secondary reflector 640, the light may then be reflected towards a target illumination area.

In all embodiments disclosed hereinabove, standard type electrical connections including ballasts, sockets, and standard wiring are employed. Applicant's invention focuses primarily on the reflective aspects of providing additional light to a target illumination area, resulting in more lighting where desired with conservation of energy.

While the invention has been described in connection with what is presently considered the most practical and preferred embodiment(s), it is to be understood that the invention is not limited to the disclosed embodiment(s) but, on the contrary is intended to cover various modifications and equivalent arrangements included within the scope of the appended claims.

What is claimed is:

1. An illumination device comprising:

an elongate primary reflector including a reflective exterior surface having a helical path extending thereon, wherein the helical path includes a groove having an interior curve partially bounding an interior space; and a helically curved light source coiled around the elongate primary reflector and spaced apart from the groove and at least partially disposed within the interior space, wherein the helically curved light source substantially follows the helical path.

2. The illumination device of claim 1, wherein:

the interior curve of the helical groove defines an effective radius; and the helically curved light source is spaced apart from the helical groove a radial distance substantially equal to half the effective radius.

3. The illumination device of claim 1, wherein the groove of the elongate primary reflector is cooperatively aligned with the helically curved light source such that the groove receives the helically curved light source as the helically curved light source is coiled around the elongate primary reflector during assembly.

4. The illumination device of claim 1, wherein the helically curved light source is a fluorescent light.

5. The illumination device of claim 1, further comprising a screw base electrical connector in electrical communication with the helically curved light source.

6. An illumination device comprising:

an elongate primary reflector;

a light source coiled around the primary reflector; and a secondary reflector having a concave reflective surface that defines an inner volume;

wherein the elongate primary reflector and the light source are disposed within the inner volume of the secondary reflector.

7. The illumination device of claim 6, wherein the secondary reflector is substantially in the shape of a paraboloid.

8. The illumination device of claim 7, wherein:

the secondary reflector includes an apex; and the elongate primary reflector and the light source are mounted to the secondary reflector at the apex.

9. The illumination device of claim 8, further comprising a curved tertiary reflector mounted to the elongate primary reflector opposite the apex of the secondary reflector and partially surrounding the elongate primary reflector and the light source.

10. The illumination device of claim 6, wherein the light source is a fluorescent light.

11. A illumination device comprising:

an elongate primary reflector including a reflective exterior surface having a helical groove extending thereon, the helical groove forming a curved channel having an effective radius; and a helical light source coiled around the elongate primary reflector in a path substantially following the helical groove, the helical light source being spaced apart from the helical groove a radial distance substantially equal to half the effective radius.

12. The illumination device of claim 11, further comprising a secondary reflector having a generally paraboloid shape with an interior reflective surface, wherein the secondary reflector is oriented around the elongate primary reflector and the helical light source such that the interior reflective surface faces the elongate primary reflector and the helical light source.

13. The illumination device of claim 12, further comprising a curved tertiary reflector having a concave reflective surface defining an open inner volume, the curved tertiary reflector being mounted to the elongate primary reflector such that at least a portion of the elongate primary reflector and the helical light source are disposed in the open inner volume.

14. The illumination device of claim 11, wherein the helical light source is a fluorescent light.

15. An illumination device comprising:

an elongate primary reflector including a reflective exterior surface having a helical path extending thereon, wherein the helical path includes a groove having an interior curve that defines an effective radius; and a helically curved light source coiled around the elongate primary reflector and spaced apart from the groove a radial distance substantially equal to half the effective radius, wherein the helically curved light source substantially follows the helical path.

16. The illumination device of claim 15, wherein the groove of the elongate primary reflector is cooperatively aligned with the helically curved light source such that the groove receives the helically curved light source as the helically curved light source is coiled around the elongate primary reflector during assembly.

17. The illumination device of claim 15, wherein the helically curved light source is a fluorescent light.

18. The illumination device of claim 15, further comprising a screw base electrical connector in electrical communication with the helically curved light source.

19. An illumination device comprising:

an elongate primary reflector including a reflective exterior surface having a helical path extending thereon;

a helically curved light source coiled around the elongate primary reflector, wherein the helically curved light source substantially follows the helical path; and a curved secondary reflector defining an open inner volume and having a concave reflective surface, wherein:

the elongate primary reflector and the helically curved light source are disposed within the open inner volume of the secondary reflector such that the concave reflective surface faces the elongate primary reflector and the helically curved light source.

20. The illumination device of claim 19, wherein the curved secondary reflector has a substantially paraboloid shape.

21. The illumination device of claim 20, wherein the curved secondary reflector includes an apex and the elongate primary reflector and the helically curved light source extending into the open inner volume substantially from the apex.

22. The illumination device of claim 19, further comprising a curved tertiary reflector mounted to the elongate primary reflector within the open inner volume of the secondary reflector.

23. The illumination device of claim 22, wherein the curved tertiary reflector at least partially surrounds the elongate primary reflector and the helically curved light source.

* * * * *